United States Patent [19]

Rothfuss

[11] 4,098,159

[45] Jul. 4, 1978

[54] SHRINK FILM PERFORATING UNIT

[76] Inventor: William John Rothfuss, 20 Buist Ave., Greenville, S.C. 29609

[21] Appl. No.: 825,880

[22] Filed: Aug. 19, 1977

Related U.S. Application Data

[63] Continuation of Ser. No. 704,893, Jul. 13, 1976, abandoned.

[51] Int. Cl.[2] ..... B26F 1/24

[52] U.S. Cl. ..... 83/171; 83/660

[58] Field of Search ..... 83/16, 171, 660

[56] References Cited

U.S. PATENT DOCUMENTS

| | | | |
|---|---|---|---|
| 2,748,863 | 6/1956 | Benton | 83/171 |
| 3,227,854 | 1/1966 | Ramsey et al. | 83/171 X |
| 3,414,937 | 12/1968 | Malmgren | 83/171 |
| 3,546,742 | 12/1970 | Kugler | 83/171 X |
| 3,707,102 | 12/1972 | Huppenthal | 83/171 |

FOREIGN PATENT DOCUMENTS

| | | | |
|---|---|---|---|
| 544,379 | 4/1942 | United Kingdom | 83/16 |

*Primary Examiner*—J. M. Meister
*Attorney, Agent, or Firm*—Arthur A. March

[57] ABSTRACT

Shrink film perforating unit for perforating thermoplastic film material, for example of the type used to wrap articles which are then subjected to heat shrinking tunnel treatment to shrink the thermoplastic material tightly around the article yet permit captive hot air to escape via such perforations, such unit being in the form of a rotary heated perforator arrangement including rotor having heatable external contact perforation points, e.g. in the form of a star wheel, and a stator with heating means captively received within an internal axial bore of the rotor for heating the external contact perforation points, with sufficient clearance being provided therebetween to permit unhindered rotation of the rotor about the stator, whereby the stator may be stationarily mounted with respect to the rotor and the rotor rotatably mounted so as to be disposable for location crosswise of the path of travel of a movable web of thermoplastic film material, e.g. maintained under slight tension by coacting conveying rollers, and in selectively spaced relation thereto for permitting the contact perforation points to engage the adjacent surface of the web operatively for heat perforation thereof upon concordant rotation of the rotor and movement of the web.

9 Claims, 2 Drawing Figures

SHRINK FILM PERFORATING UNIT

Figure 1:
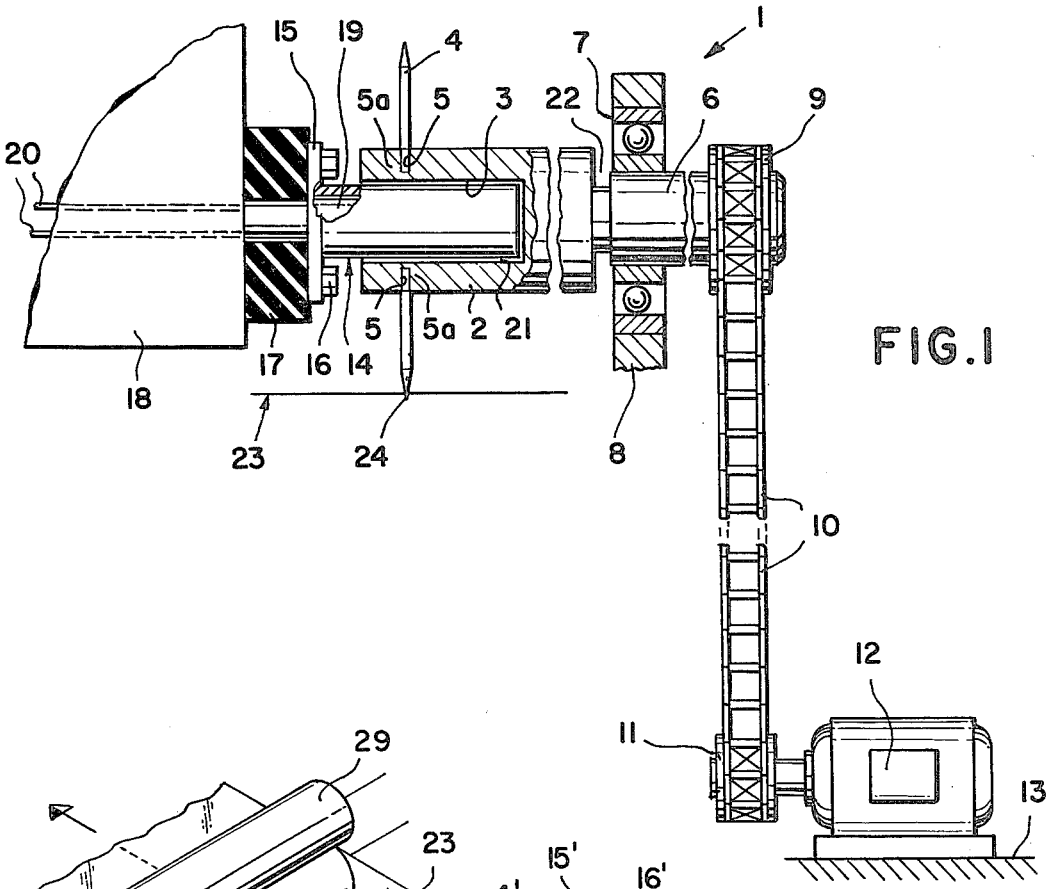

This is a continuation of copending application Ser. No. 704,893, filed July 13, 1976 and now abandoned.

The present invention relates to a shrink film perforating unit and more particularly to a rotary heated perforator arrangement for perforating thermoplastic film and including appropriately arranged rotor and stator members with the rotor member outwardly operatively receiving the stator member and having external heatable contact perforation points for perforating thermoplastic material passing along a path of travel more or less tangentially disposed with respect to the range of the contact points.

Many types of roller heater arrangements are known in which a heating element is positioned within a hollow roller for the purpose of pressing or ironing articles of wash or clothing while at the same time applying heat thereto, for example as shown in U.S. Pat. Nos. 1,037,573; 1,628,554; and 3,287,542. A similar type arrangement has also been suggested for use in processing photographic prints, negatives and the like, as noted in U.S. Pat. No. 3,086,100. All of such arrangements are intended for uniform heating throughout the length of the external surface of the particular roller for direct contact line pressure and heat transmission with respect to the adjacent planar portions of the article being treated.

It is also known that certain types of thermoplastic films may be slitted lengthwise into strips or ribbons by using parallel knives arranged tangentially with respect to the path of travel of the thermoplastic film and supplied with heat to enhance the cutting operation by means of remote heating means as noted in U.S. Pat. No. 3,251,252. As regards the multiple perforating of thermoplastic film to provide for liquid drainage, etc. in articles subsequently packaged with the film, a further arrangement is known by which a plurality of heatable probes is disposed on the surface of a roller for contact with a thermoplastic web traveling along a path arranged tangentially with respect to the roller containing the probes, and in which remotely disposed heating means are included for transmitting heat to the probes at a point more or less diametrically opposed to the point of actual contact between the probes and the thermoplastic film (U.S. Pat. No. 3,546,742). Hence, remote heating means have been provided consistently for supplying heat to knives or probes intended to be placed in contact with thermoplastic film material for cutting, perforating, or similarly treating such material, remote spatial disposition of the heating means being considered necessary to prevent direct transfer of heat from the heating means to the thermoplastic material in an uncontrolled manner and which would otherwise cause degrading or premature shrinking of the thermoplastic film and in essence detract from the main results desired.

Conventional shrink film perforating units generally contemplate the use of an axially extending rotor element rotatably mounted in spaced disposition with respect to the path of travel of the thermoplastic film, with such rotor being provided with a plurality of peripherally outwardly projecting heatable external contact perforation points so as to perforated the thermoplasitc film material as desired. In such structure, the entire unit including the heating means is arranged for common rotation, whereupon the energy supplied to the heating means can only be accomplished via the provision of appropriate slip rings on the composite rotor unit for contact with corresponding peripherally disposed brushes connectable to a source of energizing power for the heating means. Such arrangement, while purposeful, requires extra parts which are subject to accelerated wear under the circumstances and which necessitate extra power not only to achieve contact between the brushes and slip rings but also in terms of the rotation of the large mass represented by the rotor carrying not only the external contact perforation points but also the entirety of the heating means and the corresponding slip rings as well.

It is an object of the present invention to overcome the foregoing drawbacks and to provide a versatile, durable and generally trouble-free shrink film perforating unit, readily adapted for use in connection with conventional thermoplastic film treatment operations.

It is another object of the present invention to provide such a unit or arrangement which is simple and inexpensive as regards the number and types of parts and their construction and assembly.

It is still another object of the present ivention to provide a rotary heated perforator arrangement having a minimum number of moving parts and corresponding reduction in energy requirements for the overall operation of the arrangement.

Figure 2:
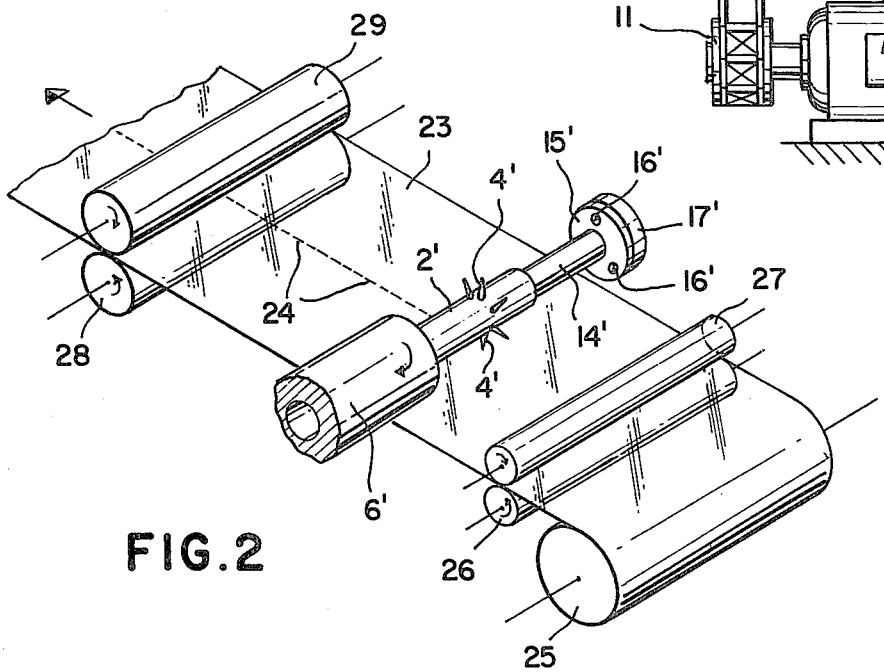

Other and further objects of the present invention will become apparent from a study of the within specification and accompanying drawings, in which;

FIG. 1 is a schematic elevational view of a rotary heated perforator arrangement in accordance with an embodiment of the present invention showing the spatial disposition and orientation of pertinent parts, and FIG. 2 is schematic perspective view of the rotary heated perforator arrangement according to the invention situated in operative relation to a web of thermoplastic film material disposed for movement along a path of travel more or less tangentially with respect to the range of the external contact perforation points used for perforating such thermoplastic film material.

In accordance with the present invention, a shrink film perforating unit is provided, such as a rotary heated perforator arrangement for perforating thermoplastic film which comprises a rotor member having an internal axial bore and a plurality of peripherally outwardly projecting heatable external contact perforation points, and a stator member having heating means operatively captively received within the axial bore of the rotor member for heating the external contact perforation points and with sufficient clearance being provided between the members to permit unhindered rotation of the rotor member about the stator member. Means are conveniently provided for stationarily mounting the stator member with respect to the rotor member and for rotatably mounting the rotor member. In this way, the rotor member is disposable for location crosswise of the path of travel of a movable web of thermoplastic film and in selectively spaced relation thereto for permitting the contact perforation points to engage the adjacent surface of the web operatively for heat perforation thereof upon concordant rotation of the rotor member and movement of the web.

In the same way, means are provided for defining a path of travel of a movable web of thermoplastic film and for moving such web therealong, whereby the rotor member and stator member may be operatively disposed crosswise of the path of travel and in selectively spaced relation thereto for permitting the contact perforation points of the rotor member to engage the adjacent surface of the web operatively for heat perforation thereof, drive means also being provided for rotating the rotor member preferably at a selective speed with respect to the movement of the web along the path of travel for achieving concordant rotation of the rotor member and movement of the web. The means for defining the path of travel and for moving the web therealong may advantageously include co-acting rollers disposed for maintaining the web under slight tension during travel within the operative range of the contact perforation points.

Preferably, the contact perforation points are arranged to project uniformly radially outwardly substantially in a common plane and in circumferentially spaced apart relation so as to form a star wheel. The heating means is advantageously in the form of a conventional type energizable heater cartridge.

In accordance with one particular feature of the present invention, the rotor member is provided with heat insulation material for substantially containing the heat generated by the heating means and in turn for substantially limiting the dissipation and transfer of such heat locally to the vicinal zones at which the contact perforation points are disposed.

Referring to the drawing, FIG. 1 shows a shrink film perforating unit 1 in the form of a rotary heated perforator arrangement for perforating thermoplastic film, which includes rotor member 2 having an internal axial bore 3 defined therein and a plurality of peripherally outwardly projecting heatable external contact perforation points 4 suitably disposed in sockets 5 defined in the external periphery of rotor member 2. Rotor member 2 is mounted on a stem 6 carried in a journal bearing 7 situated in an appropriate support 8. Stem 6 is provided at a point remote from rotor 2 with a rotor drive sprocket wheel 9 which is operatively engaged by a drive chain 10 in turn mounted at a suitably spaced position on motor drive sprocket wheel 11 which in turn is driven by variable speed motor 12. Motor 12 is of the conventional type and is situated on substrate 13 selectively positioned at a suitable distance to insure that drive chain 10 provides adequate positive force for rotating sprocket wheel 9, stem 6, rotor member 2 and in turn contact perforation points 4 in the desired manner.

Stator 14 is attached by its mounting plate 15 and mounting screws 16 via an intervening heat insulation spacing member 17 on to an appropriate support member 18 at the lateral side opposite that at which support 8 is arranged, with support 8 and support member 18 being selectively spaced apart sufficiently to permit the cartridge heater 19 of which the stator 14 is comprised to extend in nested fashion operatively captively within the axial bore 3 in rotor member 2 for heating the external contact perforation points 4. Energizing lead wires 20 extend from cartridge heater 19 through spacing member 17 to support member 18 for connection with any conventional source of electrical power (not shown). Such connection of wires 20 may be achieved merely by the use of a wall outlet plug arrangement with or without an interpose on-off switch of the conventional type, and optionally with a rheostat or other suitable means to adjust selectively the operating temperature of the cartridge heater 19 for generation of a desired quantity of heat for the purposes intended.

Sufficient clearance as at 21 is provided between rotor member 2 along the interior of axial bore 3 and the periphery of cartridge heater 19 of stator 14 to permit unhindered rotation of rotor member 2 about stator member 14, i.e. without touching of these relatively rotationally arranged interposed or telescoping parts.

In this way, upon energizing cartridge heater 19, heat therefrom will be imparted across clearance 21 to the vicinal zones **5*a* at sockets 5 and in turn to the contact perforation points 4 so as to heat the same. Preferably, perforation points 4 will be made of copper or other readily heat conductive metal or metallic material to provide for maximum efficiency in heat transfer from stationery cartridge heater 19 across clearance 21 thereto for the desired perforation of the thermoplastic film 23 so as to form the spaced apart perforations 24 (cf. FIG. 2). Because the contact between perforation points 4 and thermoplastic film 23 is targential in nature and momentary in duration, such contact perforation points may be made selectively from relatively soft metal or metallic material. The extremely localized heat from the tips of perforation points 4 is sufficient under the operating conditions to cause perforations 24 to occur in the moving thermoplastic film 23** without the need for pronounced physical pressure between the concordantly moving parts in question and without such parts sticking undesirably to each other.

An air gap 22 is provided at the lateral end portion of rotor member 2 in the vicinity of support 8 so as to minimize adverse effects of heat from the cartridge heater reaching that area of the unit, and particularly to diminish the influence of heat on the journal bearing 7 and related parts of the drive system in the drive train to motor 12. By selectively providing rotor member 2 of heat insulation material, such as suitable thermosetting plastic material, the heat generated by cartridge heater 19 is substantially contained within axial bore 3 and substantially limited in its dissipation and transfer locally to the vicinal zones **5*a* at which the contact perforation points 4 are disposed. Protection is afforded at the opposite end of the unit with regard to any heat emanating along clearance 21 by reason of the interposed spacing member 17 between stator 14 and support member 18**.

It will be realized that support 8 and support member 18 are arranged in fixed relation with respect to each other so that the entire composite assembly will be maintained in spaced relation to the thermoplastic film 23. For this purpose, support 8 and support member 18 may be suitably mounted for conjoint displacement vertically as well as for opposed displacement toward and away from each other along the axis of rotation of sprocket wheel 9 in order to provide appropriate adjustments in the positioning of rotor member 2 and stator member 14 with respect to each other while providing the desired clearance 21 therebetween. Accordingly, while such adjusting means are not specifically shown, because of their conventional nature, the artisan will readily appreciate the inclusion of any means to accomplish the foregoing spatial positioning of the unit 1 with respect to the thermoplastic film 23 and so as to achieve the relative rotational disposition of rotor member 2 and stator member 14 with respect to each other. Suitable conjoint positional adjustment of variable speed motor 12 may be undertaken by conventional means (not shown) consonant with any positional adjustment of unit 1, e.g. in terms of the selective vertical positioning thereof with respect to the path of thermoplastic film

23.

As shown in FIG. 2, the thermoplastic film to be perforated is carried on a feed roller 25 of the usual type so that thermoplastic film 23 passes between a pair of co-acting rollers 26 and 27 upstream of the unit of the invention and passes between a further pair of co-acting rollers 28 and 29 downstream of such unit. Rollers 26 and 28 may be provided as conventional drive rollers and rollers 27 and 29 may be provided as conventional idler rollers, with the two pairs of rollers being maintained such that the web of thermoplastic material 23 is maintained under slight tension during travel along its path within the operative range of the contact perforation points in question.

In the form of the unit shown in FIG. 2, the rotor member 2' carries the contact perforation points 4' such that the points project uniformly radially outwardly substantially in a common plane and in circumferentially spaced apart relation to form a star wheel. Stator 14' is shown mounted via its mounting plate 15' and mounting screw 16' through the intervening heat insulation spacing member 17' on an appropriate support member (not shown) in the same manner as indicated in FIG. 1. At the opposite side of the unit, the stem 6' which carries rotor member 2' is shown and which is mounted for rotation in the direction of the appropriate arrow by a conventional arrangement (not shown) similar to that noted in FIG. 1.

It will be appreciated that rollers 26 and 28 may be arranged for rotation by appropriate drive means (not shown) at a selective common speed of rotation synchronized with the speed of rotation of variable speed motor 12 to achieve concordant rotation of rotor member 2' and movement of the web of thermoplastic film 23 for imparting perforations via contact perforation points 4' to the thermoplastic film in uniform spaced apart sequence as shown by perforations 24 in FIG. 2.

It will be realized that by providing the stationary cartridge heater of the stator member in captive relation within the axial bore of the rotor member, and by concomitant selection of the operative length of the contact perforation points, the heat generated by the cartridge heater will be sufficiently distant from the range of operation of the tips of the perforation points and from the corresponding path of travel of the web that direct application of such heat to the heat shrinkable thermoplastic film material will be advantageously prevented and in turn adverse effect of such film material, e.g. thermal degrading or premature shrinking thereof, as would otherwise be occasioned thereby. Instead, a long-wearing simple overall unit is provided in which only the relatively light-weight substantially hollow perforation point-containing rotor member must rotate while the relatively heavy-weight heating means remains stationary for ease in energizing the same, yet without adverse effect on the heat-sensitive thermoplastic material even though such heating means is relatively central in terms of the spatial disposition and orientation of the concerned stationary and moving parts and material and/or is optionally selected to be comparatively more intense or hotter in its operational temperature than analogous conventional systems or units.

The so-perforated thermoplastic film material may be appropriately collected on a take-up roller (not shown) for use in wrapping articles thereafter subjected to heat shrinking tunnel treatment whereby to shrink the thermoplastic material tightly around the articles while permitting otherwise captive hot air to escape via such perforations in the desired manner.

It will be appreciated that the foregoing specification and accompanying drawing are set forth by way of illustration and not limitation and that various modifications may be made therein without departing from the spirit and scope of the present invention which is to be limited only by the scope of the appended claims.

What is claimed is:

1. Rotary heater perforator arrangement for perforating thermoplastic film which comprises:

a rotor member having an internal axial bore open at one end of the rotor member and a plurality of peripherally outwardly projecting heatable external contact perforation points on the rotor member and operatively arranged for receiving heat from within such axial bore, a stator member having heating means operatively captively received within the axial bore at the open end of the rotor member for heating the external contact perforation points from within such axial bore and with sufficient clearance being provided between the members to permit unhindered rotation of the rotor member about the stator member, said rotor member being provided with heat insulation material for substantially containing the heat generated by the heating means and for substantially limiting the dissipation and transfer of such heat locally to the vicinal zones at which the external contact perforation points are disposed and distally through such clearance to the open end of the rotor member, and stationarily mounting means for stationarily mounting the stator member with respect to the rotor member and rotatably mounting means arranged for rotatably mounting the rotor member at a mounting location spatially and heat insulatedly operatively isolatingly remote from the heating means and from the open end of the rotor member, whereby the rotor member is disposable for location crosswise of the path of travel of a movable web of thermoplastic film and in selectively spaced relation thereto for permitting the contact perforation points to engage the adjacent surface of the web operatively for heat perforation thereof upon concordant rotation of the rotor member and movement of the web.

2. Arrangement according to claim 1 wherein drive means are provided for rotating the rotor member at a selective speed.

3. Arrangement according to claim 1 wherein the contact perforation points project uniformly radially outwardly substantially in a common plane and is circumferentially spaced apart relation to form a star wheel.

4. Arrangement according to claim 1 wherein the heating mean is in the form of an energizable heater cartridge.

5. Arrangement according to claim 1 wherein means are provided for defining a path of travel of a movable web of thermosplastic film and for moving such web therealong, said rotor member and stator member being operatively disposed crosswise of the path of travel and in selectively spaced relation thereto for permitting the contact perforation points of the rotor member to engage the adjacent surface of the web operatively for heat perforation thereof, and drive means are provided for rotating the rotor member at a selective speed with respect to the movement of the web along the path of travel for concordant rotation of the rotor member and movement of the web.

6. Arrangement according to claim 5 wherein the means for defining the path of travel and for moving such web therealong include coacting rollers disposed for maintaining the web under slight tension during travel within the operative range of the contact perforation points.

7. Arrangements according to claim 6 wherein the contact perforation points project uniformly radially outwardly substantially in a common plane and in circumferentially spaced apart relation to form a star wheel and the heating means is in the form of an energizable heater cartridge.

8. Arrangement according to claim 1 wherein the heating means is in the form of an energizable heater cartridge and the rotatably mounting means are arranged at a mounting location which is radially and axially remote from the heating means, from the open end of the rotor member, from the stator member as well as from the stationarily mounting means.

9. Rotary heater perforator arrangement for perforating thermoplastic film which comprises:

a rotor member having an internal axial bore open at one end of the rotor member and closed at the other end thereof and a plurality of peripherally outwardly projecting heatable external contact perforation points on the rotor member and operatively arranged for receiving heat from within such axial bore, a stator member having heating means operatively capatively received within the axial bore at the open end of the rotor member for heating the external contact perforation points from within such axial bore and with sufficient clearance being provided between the members to permit unhindered rotation of the rotor member about the stator mmember, said rotor member being peripherally provided with heat insulation material for substantially containing the heat generated by the heating means and for substantially limiting the dissipation and transfer of such heat locally to the vicinal zones at which the external contact perforation points are disposed and distally through such clearance to the open end of the rotor member, stationarily mounting means on one side of the arrangement for stationarily mounting the stator member with respect to the rotor member at one axial end of the stator member with the other axial end thereof being in the form of a stator free end, and rotatably mounting means on the opposite side of the arrangement for rotatably mounting the rotor member with respect to the stator member at one axial end of the rotor member with the other axial end thereof being in the form of a rotor free end provided with such axial bore, the stator free end being provided with such heating means in telescopingly received relation with the rotor free end provided with such axial bore and the rotatably mounting means thereby being arranged as a mounting location which is radially and axially as well as heat insulatedly operatively isolatingly remote from the heating means, from the open end of the rotor member, from the stator member as well as from the stationarily mounting means, whereby the rotor member is disposable for location crosswise of the path of travel of a movable web of thermoplastic film and in selectively spaced relation thereto for permitting the contact perforation points to engage the adjacent surface of the web operatively for heat perforation thereof upon concordant rotation of the rotor member and movement of the web.

* * * * *